US011403970B2

(12) United States Patent
McEnery

(10) Patent No.: US 11,403,970 B2
(45) Date of Patent: Aug. 2, 2022

(54) PROTECTIVE DISPLAY CASES FOR COLLECTIBLES

(71) Applicant: Slab Strong LLC, Rumford, RI (US)

(72) Inventor: Timothy McEnery, Rumford, RI (US)

(73) Assignee: Slab Strong LLC, Rumbord, RI (US)

( * ) Notice: Subject to any disclaimer, the term of this patent is extended or adjusted under 35 U.S.C. 154(b) by 0 days.

(21) Appl. No.: 17/556,160

(22) Filed: Dec. 20, 2021

(65) Prior Publication Data

US 2022/0114919 A1 Apr. 14, 2022

Related U.S. Application Data

(60) Provisional application No. 63/166,006, filed on Mar. 25, 2021.

(51) Int. Cl.

| | |
|---|---|
| ***G09F 1/12*** | (2006.01) |
| ***A45C 11/24*** | (2006.01) |
| *G09F 1/10* | (2006.01) |

(52) U.S. Cl.

CPC ..... *G09F 1/12* (2013.01); *A45C 11/24* (2013.01); *G09F 2001/106* (2013.01)

(58) Field of Classification Search

CPC ..... G09F 1/10; G09F 1/12; G09F 1/14; G09F 2001/106; G09F 3/20; G09F 3/18; A45C 11/24; A47G 1/12; A47G 1/0605; A47G 1/065; A47G 2001/0688; A47F 7/146

See application file for complete search history.

(56) References Cited

U.S. PATENT DOCUMENTS

| | | | | |
|---|---|---|---|---|
| 362,842 | A * | 5/1887 | Kellogg et al. | G09F 1/12 40/647 |
| 1,538,233 | A * | 5/1925 | Bastian | G09F 3/18 40/653 |
| 2,403,701 | A * | 7/1946 | Zuber | A47G 1/0633 40/778 |
| 3,751,128 | A * | 8/1973 | Skinner | A47F 7/03 63/23 |
| 4,602,447 | A * | 7/1986 | Feingold | B42F 7/02 402/79 |
| 4,697,364 | A | 10/1987 | Dean | |

(Continued)

OTHER PUBLICATIONS

"Nyko, Aug. 6, 2020, Nyko Technologies, https://nyko.com/products/silicone-grip-cover-for-nintendo-switch-lite." (Year: 2020).*

*Primary Examiner* — Patrick D Hawn

(74) *Attorney, Agent, or Firm* — Adler Pollock & Sheehan P.C.

(57) ABSTRACT

Protective display cases for collectibles, such as trading cards, rare coins and comic books. Such collectibles are often graded to increase their value, where the collectible is labelled and contained within a sleeve (i.e., a clear plastic sleeve). The protective display case includes a first compartment sized and shaped to receive and at least partially enclose the collectible and a first portion of the sleeve holding the collectible without obscuring visibility of the collectible, a second compartment adjoining the first compartment and sized and shaped to receive and at least partially enclose the label and a second portion of the sleeve holding the label without obscuring visibility of the label, a first end proximate the first compartment; and a second end proximate the second compartment, opposite the first end.

16 Claims, 4 Drawing Sheets

(56) References Cited

U.S. PATENT DOCUMENTS 4,878,579 A * 11/1989 Hager ..... G09F 1/12 206/0.83
5,010,673 A 4/1991 Connor et al.
5,011,005 A * 4/1991 Boyd ..... G09F 3/00 206/0.81
5,040,671 A * 8/1991 Hager ..... A45C 11/18 206/39
5,050,324 A 9/1991 Casull
5,074,593 A * 12/1991 Grosso ..... G09F 1/10 283/109
5,097,953 A * 3/1992 Gingras ..... G09F 1/10 206/39
5,109,977 A * 5/1992 Mayer ..... A47G 1/12 206/508
5,119,574 A * 6/1992 King ..... G09F 5/04 206/39
5,121,563 A 6/1992 Connor et al.
5,168,988 A * 12/1992 Johnnston ..... B42D 15/045 206/0.81
5,245,775 A * 9/1993 Goserud ..... G09F 1/10 40/776
5,287,641 A 2/1994 Showers
5,553,702 A * 9/1996 Walsh ..... G09F 1/10 206/38
5,730,291 A * 3/1998 Smallwood ..... G09F 3/20 206/455
6,029,807 A * 2/2000 Love ..... B65D 85/48 206/0.82
6,052,933 A 4/2000 Lytle
6,119,381 A * 9/2000 Grocholski ..... B42F 5/005 40/377
D439,058 S 3/2001 Freiberg
D469,963 S * 2/2003 Ueno ..... D6/300
D477,135 S * 7/2003 Fu ..... D3/247
7,117,998 B2 * 10/2006 Krapf ..... G09F 15/00 40/124.05
7,603,802 B2 10/2009 Oudekerk et al.
D641,579 S * 7/2011 Wynalda, Jr ..... D6/628
8,042,294 B2 10/2011 Snider et al.
8,191,295 B2 * 6/2012 Junkins ..... G09F 1/12 206/455
8,376,133 B2 2/2013 Macor
8,439,191 B1 * 5/2013 Lu ..... A45C 11/00 455/575.8
8,584,841 B1 * 11/2013 Tiegs ..... B65D 69/00 206/38.1
8,595,969 B1 * 12/2013 Wheelis ..... A47G 1/12 206/778
8,813,403 B2 8/2014 Weinert
8,833,426 B2 9/2014 Ebbesen et al.
9,139,358 B2 9/2015 Levitan
D748,978 S 2/2016 Glass et al.
D759,981 S * 6/2016 Roper ..... D6/300
9,548,005 B2 1/2017 Willoughby
9,907,417 B2 * 3/2018 Brown, III ..... A47G 1/12
D816,149 S * 4/2018 Dalton ..... D16/237
10,459,931 B2 10/2019 Kass et al.
10,516,431 B2 * 12/2019 DiLella ..... H04B 1/3888
D903,645 S * 12/2020 Lee ..... D14/250
11,178,984 B2 * 11/2021 Derndinger ..... A47F 7/146
2002/0073590 A1 * 6/2002 Crisp ..... G09F 1/12 40/792
2003/0196362 A1 10/2003 Harwell
2004/0187372 A1 9/2004 Dorizas
2007/0187266 A1 8/2007 Porter et al.
2008/0163524 A1 * 7/2008 Broehl ..... A47G 1/1606 40/745
2008/0187688 A1 8/2008 Gunther
2010/0115810 A1 5/2010 Morera
2013/0132810 A1 * 5/2013 Jandt ..... G09F 1/12 40/606.01
2017/0213487 A1 7/2017 Blommel
2020/0178657 A1 6/2020 Van Geer
2021/0022467 A1 * 1/2021 Cox ..... A45C 13/1069

* cited by examiner

PROTECTIVE DISPLAY CASES FOR COLLECTIBLES

RELATED APPLICATION

This application claims the priority of U.S. Provisional Patent Application Ser. No. 63/166,006, filed Mar. 25, 2021, which is incorporated by reference herein in its entirety.

FIELD OF THE INVENTION

The invention relates to display cases, and more particularly, protective display cases for holding collectibles such as rare coins, trading cards and comic books.

BACKGROUND OF THE INVENTION

"Grading" is the practice of submitting a collectible (e.g., a rare coin, a trading card (e.g., gaining cards, sports cards (such as baseball cards), and other collectible cards) or a comic book) to a third-party service (e.g., PSA, CGC, HGA, WATA, PCS, Beckett or any others) that inspects the collectible for authenticity and ranks it (e.g., on a 10-point scale), for its condition. The collectible is then assigned an overall grade that typically increases the value of the collectible (e.g., up to triple the value of the ungraded collectible).

The graded collectible is sealed in a tamper-proof plastic holder or display sleeve (e.g., the plastic holder/sleeve is snapped on/around the graded card and clamped down with sufficient pressure to seal it), and then assigned a cataloged serial number that is printed on a label. The label and serial number are necessary because grading companies publish population reports on the number and types of graded collectibles that are on the market.

The holder/sleeve is typically clear plastic so that the card and serial number (and other information on the label) are visible, as illustrated in FIGS. 1 and 2 (for a graded sports trading card). Once sealed, the clear plastic holder/sleeve H becomes synonymous/integral with the graded card C and label L, all of which constitute a graded card assembly G. As part of the graded card assembly G, the clear plastic holder/sleeve H itself merits protection (i.e., from cracking/breakage, discoloration and/or other damage).

SUMMARY OF THE INVENTION

Disclosed herein are embodiments of protective display cases for collectibles.

Disclosed herein is an embodiment of a protective display case for a collectible having a label and contained within a sleeve. The protective display case comprises a first compartment sized and shaped to receive and at least partially enclose the collectible and a first portion of the sleeve holding the collectible; a second compartment adjoining the first compartment and sized and shaped to receive and at least partially enclose the label and a second portion of the sleeve holding the label; a first end proximate the first compartment; and a second end proximate the second compartment, opposite the first end.

Further disclosed herein is another embodiment of a protective display case for a graded collectible assembly including a graded collectible, a label associated with the graded collectible and a clear plastic sleeve holding the collectible and label. The protective display case comprises a first compartment sized and shaped to receive and at least partially enclose a first portion of the graded collectible assembly holding the collectible; and a second compartment adjoining the first compartment and sized and shaped to receive and at least partially enclose a second portion of the graded collectible assembly holding the label. In various embodiments, the protective display case includes first and second ends.

Also disclosed herein are protective display cases as discussed above, wherein the first and second compartments include respective sets of walls having channels sized and shaped to receive and secure the respective portions of the graded collectible assembly holding the collectible and label therein without obscuring visibility of the collectible and label through the first and second compartments, respectively.

This Summary of the Invention is neither intended nor should it be construed as being representative of the full extent and scope of the present disclosure. The present disclosure is set forth in various levels of detail in the Summary of the Invention as well as in the attached drawings and the Detailed Description of the Invention, and no limitation as to the scope of the present disclosure is intended by either the inclusion or non-inclusion of elements, components, etc. in this Summary of the Invention. Additional aspects of the present disclosure will become more readily apparent from the Detailed Description, particularly when taken together with the drawings.

The above-described benefits, embodiments, and/or characterizations are not necessarily complete or exhaustive, and in particular, as to the patentable subject matter disclosed herein. Other benefits, embodiments, and/or characterizations of the present disclosure are possible utilizing, alone or in combination, as set forth above and/or described in the accompanying figures and/or in the description herein below. However, the Detailed Description of the Invention, the drawing figures, and the exemplary claim set forth herein, taken in conjunction with this Summary of the Invention, define the invention.

BRIEF DESCRIPTION OF THE DRAWINGS

Embodiments of the invention are further described but are in no way limited by the following illustrations.

The accompanying figures, which are incorporated in and constitute a part of the specification, illustrate preferred embodiments of the invention and, together with the description, serve to explain the objects, advantages, and principles of the invention. Embodiments of the invention are in no way limited by the following figures.

DETAILED DESCRIPTION OF THE INVENTION

Figure 1:
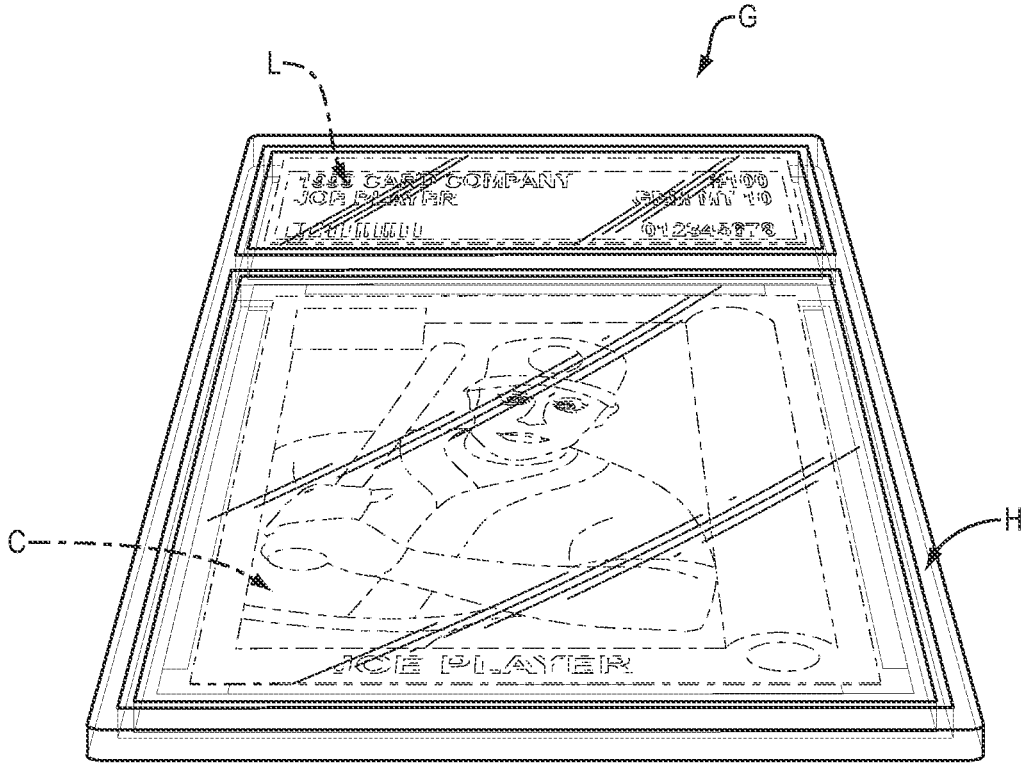
FIG. 1 shows a graded trading card with its label in a clear plastic holder/sleeve, all of which constitute a graded card assembly.
Figure 2:
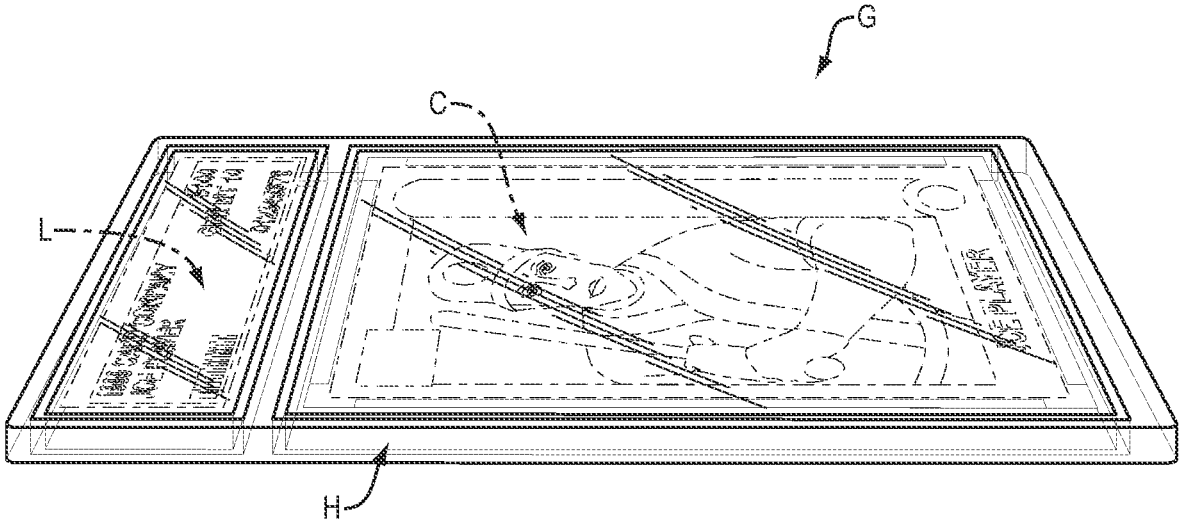
FIG. 2 is a side view of the graded card assembly (graded trading card/label/clear plastic holder/sleeve) of FIG. 1.

Disclosed herein are protective display cases collectibles. The protective display cases are configured for a graded collectible assembly G, which includes a graded collectible C, its label L and the clear plastic holder/sleeve H holding the collectible and label, as shown in FIGS. 1 and 2.

The embodiments of the protective display case described below and shown in the figures are configured for use with a graded trading card (e.g., a gaining card, sports card (such as a baseball card), and other collectible cards). However, also included within the scope of the present invention are various embodiments of protective display cases that are configured for use with other graded collectibles. Such collectibles include, but are not limited to, rare coins and comic books.

Figure 3:
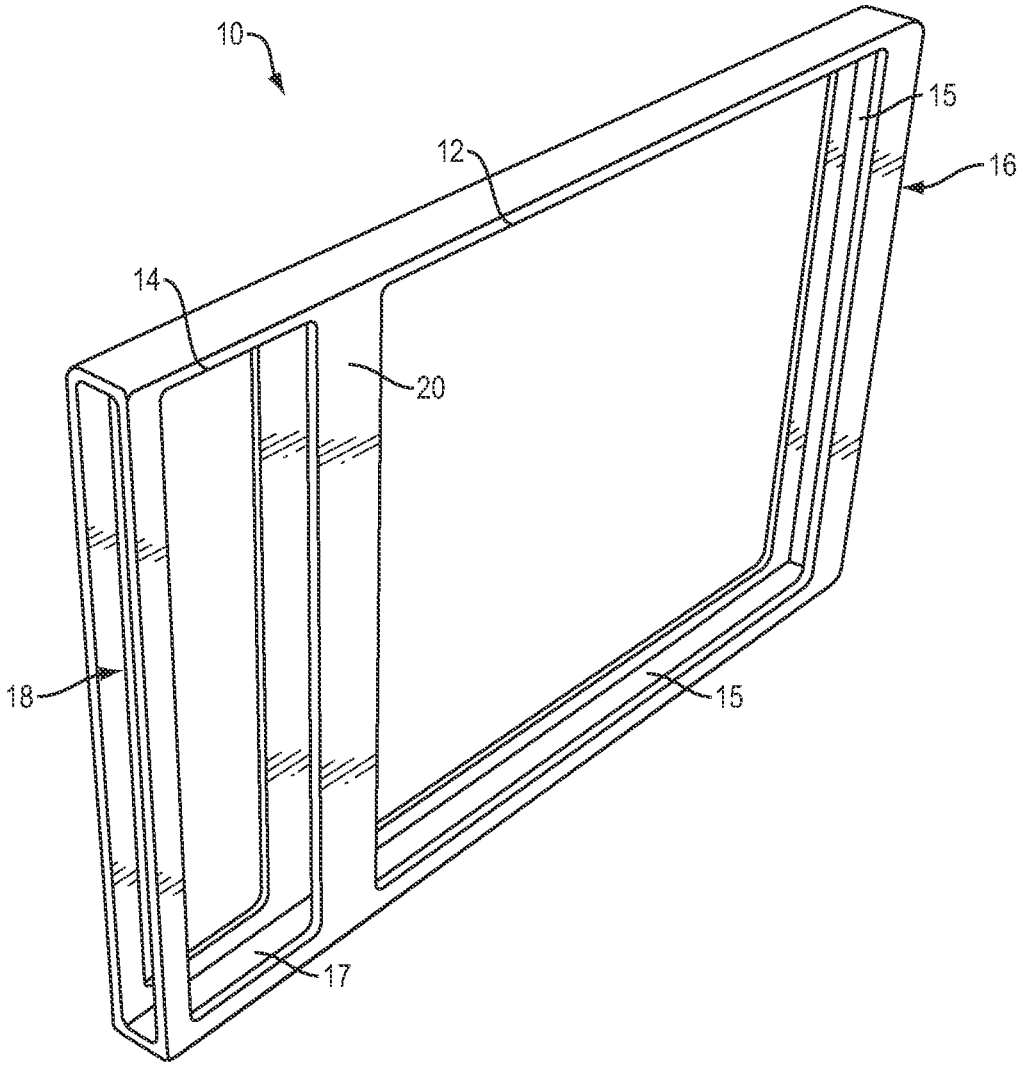
FIG. 3 is a top/side perspective view of a protective graded trading card display case according to a first embodiment of the present invention.
Figure 4:
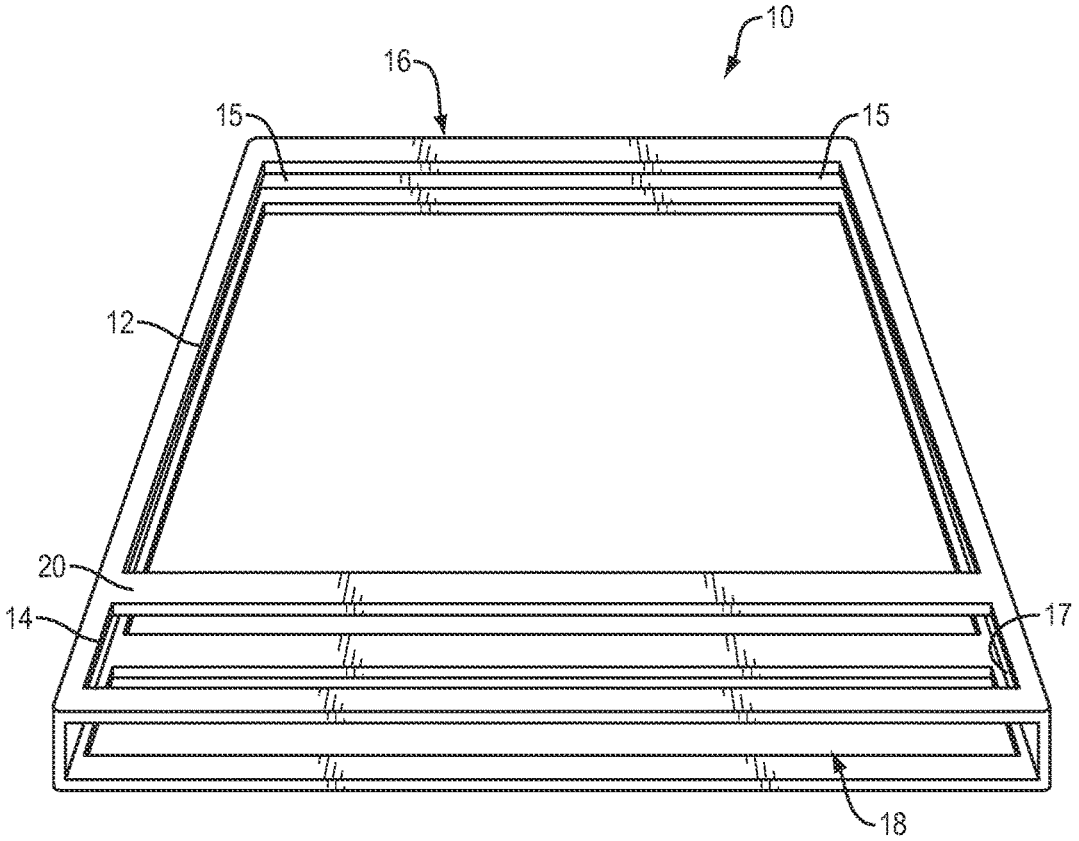
FIG. 4 is a top plan/elevational view of the protective graded trading card display case of FIG. 3.
Figure 5:
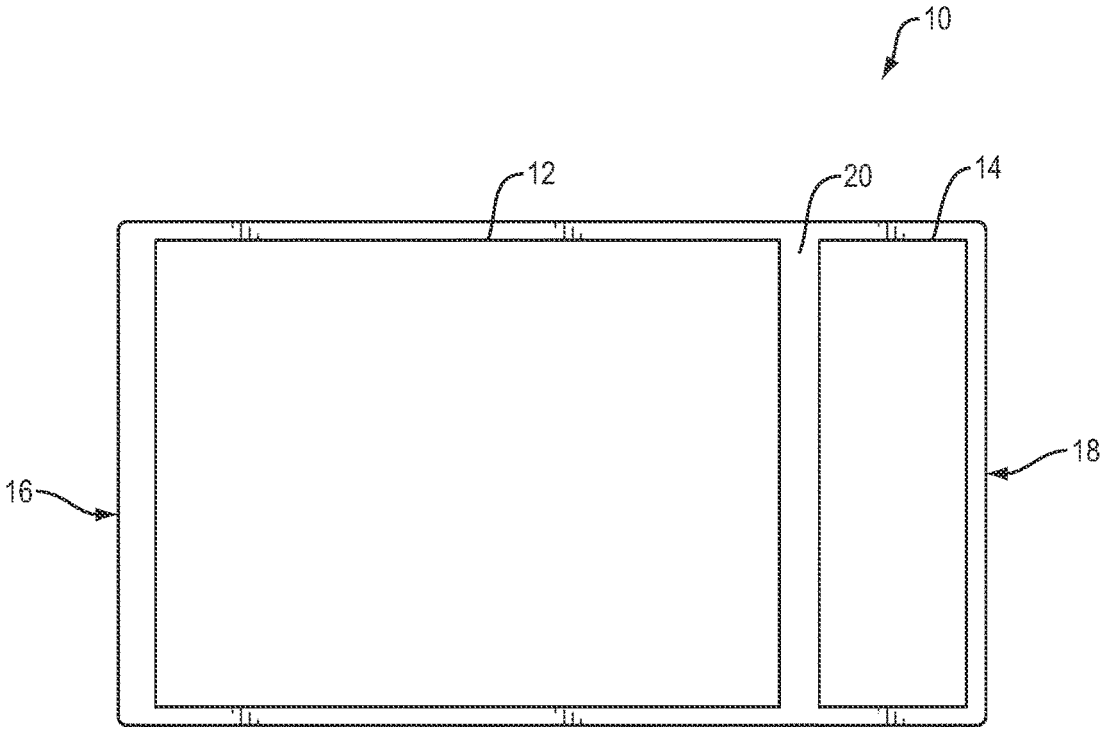
FIG. 5 is top/front perspective view of the protective graded trading card display case of FIG. 3.

An embodiment of the protective display case of the present invention is illustrated in FIGS. 3-5. The protective display case 10 has a substantially rectangular shape and includes two adjoining compartments—a first, or card, compartment 12 and a second, or label, compartment 14, each of which also has a substantially rectangular shape. The card compartment 12 is sized and shaped to removably receive and at least partially enclose the graded card C and its associated portion of the clear plastic holder/sleeve H (see FIGS. 1 and 2) therein. The label compartment 14 is sized and shaped to removably receive and at least partially enclose the label L and its associated portion of the clear plastic holder/sleeve H therein.

Referring to FIGS. 3 and 4, the card compartment 12 includes three adjoining walls having channels, or grooves, 15 that are sized and shaped to receive the graded card portion of the clear plastic holder/sleeve H therein. The channels 15 fit snugly over three corresponding edges of the graded card portion of the clear plastic holder/sleeve H without obscuring the photograph and other information on the card C, which are thereby visible through the card compartment 12. The label compartment 14 includes two opposed walls having channels, or grooves, 17 that are sized and shaped to receive the label portion of the clear plastic holder/sleeve H therein. The channels 17 fit snugly over two corresponding opposed edges of the label portion of the clear plastic holder/sleeve H without obscuring the serial number and other information on the label L, which are thereby visible through the label compartment 14.

The protective display case 10 also includes a first, closed end 16 proximate the card compartment 12, and a second, open end 18 proximate the label component 14, opposite the closed end 16. The open end 18 is sized and shaped so that the graded trading card assembly G can easily be inserted and removed therethrough.

The protective display case 10 also includes at least one separation member 20 disposed between the card compartment 12 and the label compartment 14, so as to provide a border or separation between the graded card C and the label L. The embodiment shown in FIGS. 3-5 includes a pair of separation members 20 that extend across the display case 10, and that are generally parallel to the first and second ends 16, 18.

In various embodiments, the protective display case 10 can be formed from various suitable materials. Such materials include, but are limited to, different plastics (including, but not limited to, Polyethylene Terephthalate, High-Density Polyethylene, Polyvinyl Chloride, Polypropylene, Polystyrene or Styrofoam, resins, metallic resins, or combinations thereof), metals (including, but not limited to, aluminum, platinum, gold, silver, steel, or combinations/alloys thereof), and other materials (including, but not limited to, wood, rubber, silicone, leather, fabric, cotton, cardboard, or combinations thereof).

The protective display case 10 can be formed in different colors and/or styles to make it more aesthetically pleasing. The protective display case 10 can also be decorated with various logos, designs and/or other indicia, or personalized, to make it more attractive. These decorations may include, as non-limiting examples, team logos, team colors, custom logos, printed fabric, and stitched leather.

In operation, an owner (or other handler) of a graded trading card C seeks to protect the card and entire graded trading card assembly G, and therefore acquires the protective display case 10 of the present invention for such purpose. The owner slides the graded trading card assembly G through the open second end 18 of the protective display case 10, advancing the graded card C and its portion of the clear plastic holder/sleeve H through the open second end 18 first, followed by the label L and its portion of the clear plastic holder/sleeve H. The owner then positions three edges of the graded card portion of the clear plastic holder/sleeve H within the channels 15 of the card compartment 12, and positions two opposed edges of the label portion of the clear plastic holder/sleeve H within the channels 17 of the label compartment 14. Once the graded trading card assembly G has been properly positioned within the protective display case 10, the photograph and other information on the card C is visible through the card compartment 12, and the serial number and other information on the label L is visible through the label compartment 14. The graded trading card assembly G is thereby protected by the protective display case 10, maintaining its value.

Figure 7:
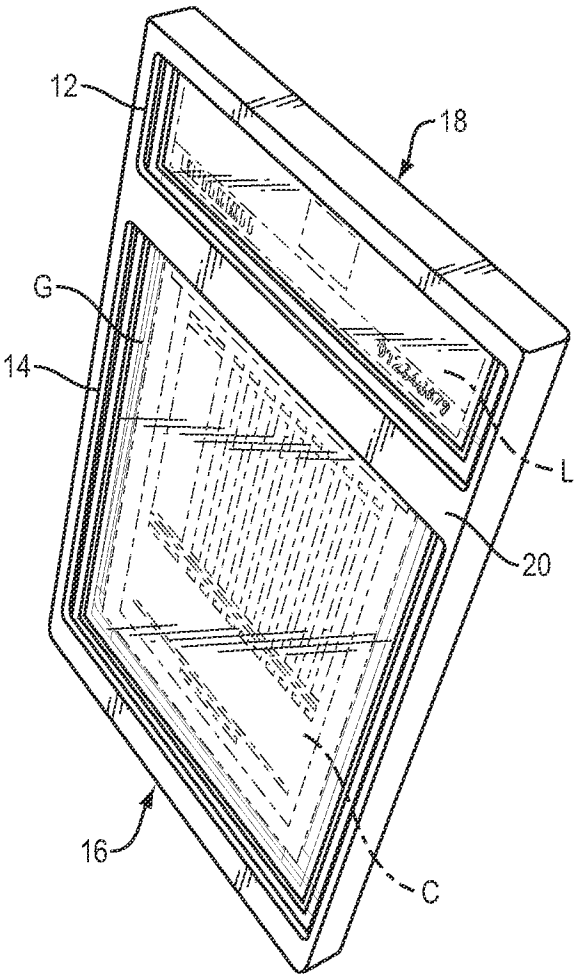
FIG. 7 is top rear perspective view of a protective graded trading card display case according to a second embodiment of the present invention.
Figure 6:
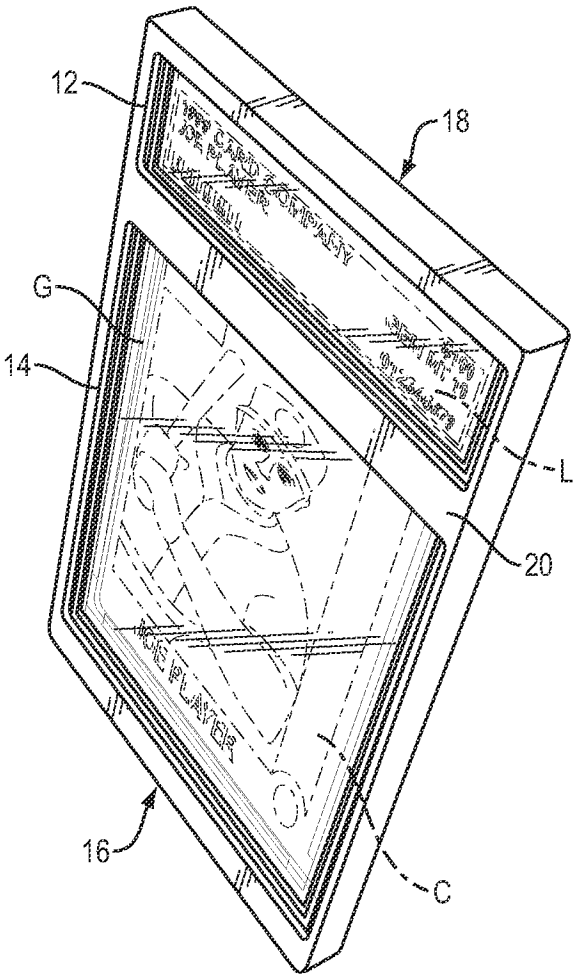
FIG. 6 is top front perspective view of a protective graded trading card display case according to a second embodiment of the present invention.

In another embodiment of the protective display case illustrated in FIGS. 6 and 7, the first and second ends 16, 18 (i.e., proximate the label compartment 14 and proximate the card component 12) are both closed. In this embodiment, the protective display case constitutes a continuous border, and is formed from a flexible, elastic material (i.e., rubber) so that it can be manipulated to have the graded trading card assembly G inserted and secured therein.

In various embodiments, the protective display case may be formed from two or more pieces that are configured to cooperate and fit together to enclose the graded trading card assembly therein. The cooperating portions of the two pieces include, as a non-limiting example, interlocking male and female members. Any other means for securing the two pieces together to form the assembled protective display case may also be utilized.

Modifications, additions, or omissions may be made to the systems, apparatuses, and methods described herein without departing from the scope of the disclosure. For example, the components of the systems and apparatuses may be integrated or separated. Moreover, the operations of the systems and apparatuses disclosed herein may be performed by more, fewer, or other components and the methods described may include more, fewer, or other steps. Additionally, steps may be performed in any suitable order. As used in this document, "each" refers to each member of a set or each member of a subset of a set.

Other embodiments of the invention will be apparent to those skilled in the art from consideration of the specification and practice of the invention disclosed herein. Although specific advantages have been enumerated above, various embodiments may include some, none, or all of the enumerated advantages. It is intended that the embodiments described above be considered as exemplary only, with a true scope and spirit of the invention being indicated by the appended claims. Moreover, none of the features disclosed in this specification should be construed as essential elements, and therefore, no disclosed features should be construed as being part of the claimed invention unless the features are specifically recited in the claims. In addition, it should be understood that any of the features disclosed on any particular embodiment may be incorporated in whole or in part on any of the other disclosed embodiments.

In any interpretation of the claims appended hereto, it is noted that no claims or claim elements are intended to invoke or be interpreted under 35 U.S.C. 112(f) unless the words "means for" or "step for" are explicitly used in the particular claim.

In general, any combination of disclosed features, components and methods described herein is possible. Steps of a method can be performed in any order that is physically possible.

All cited references are incorporated by reference herein.

Although embodiments have been disclosed, it is not desired to be limited thereby. Rather, the scope should be determined only by the appended claims.

While various embodiment of the present disclosure have been described in detail, it is apparent that modifications and alterations of those embodiments will occur to those skilled in the art. However, it is to be expressly understood that such modifications and alterations are within the scope and spirit of the present disclosure, as set forth in the following claims.

The foregoing discussion of the disclosure has been presented for purposes of illustration and description. The foregoing is not intended to limit the disclosure to the form or forms disclosed herein. In the foregoing Detailed Description for example, various features of the disclosure are grouped together in one or more embodiments for the purpose of streamlining the disclosure. This method of disclosure is not to be interpreted as reflecting an intention that the claimed disclosure requires more features than are expressly recited in each claim. Rather, as the following claims reflect, inventive aspects lie in less than all features of a single foregoing disclosed embodiment. Thus, the following claims are hereby incorporated into this Detailed Description, with each claim standing on its own as a separate preferred embodiment of the disclosure.

Moreover, though the present disclosure has included description of one or more embodiments and certain variations and modifications, other variations and modifications are within the scope of the disclosure, e.g., as may be within the skill and knowledge of those in the art, after understanding the present disclosure. It is intended to obtain rights which include alternative embodiments to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

I claim:

1. A protective display case for a graded trading card having a label and contained within a single sleeve sized and shaped to hold the graded trading card, the single sleeve press-fit into the protective display case, the protective display case comprising:

a first chamber sized and shaped to receive and at least partially enclose the graded trading card and a first portion of the single sleeve holding the graded trading card;

a second chamber adjoining the first chamber and sized and shaped to receive and at least partially enclose the label and a second portion of the single sleeve holding the label;

a first end proximate the first chamber; and a second end proximate the second chamber, opposite the first end, wherein the first chamber includes three adjoining walls having channels sized and shaped to receive and secure the first portion of the single sleeve holding the graded trading card therein without obscuring visibility of the graded trading card through the first chamber, wherein the second chamber includes at least two walls having channels sized and shaped to receive and secure the second portion of the single sleeve holding the label therein without obscuring visibility of the label through the second chamber.

2. The display case of claim 1, wherein the first end and second end are closed ends.

3. The display case of claim 2, wherein the display case is formed from a flexible, elastic material, whereby a user can manipulate the display case to insert and secure the sleeve and graded trading card therein.

4. The display case of claim 1, wherein the first end is open and the second is closed, and wherein the open first end is sized and shaped to receive the single sleeve and graded trading card therethrough.

5. The display case of claim 1, further comprising at least one separation member disposed between the first and second chambers, so as to provide a border or separation between the first portion of the single sleeve holding the graded trading card and the second portion of the single sleeve holding the label.

6. The display case of claim 1, wherein the display case is formed from a material selected from a group consisting of plastic, metal, wood, rubber, silicone, leather, fabric, cotton, cardboard, and combinations of one or more thereof.

7. The display case of claim 6, wherein the plastic is selected from a group consisting of Polyethylene Terephthalate, High-Density Polyethylene, Polyvinyl Chloride, Polypropylene, Polystyrene or Styrofoam, resins, metallic resins, and combinations of one more thereof).

8. The display case of claim 6, wherein the metal is selected from a group consisting of aluminum, platinum, gold, silver, steel, alloys of one or more thereof, and combinations of one more thereof.

9. A protective display case for a graded trading card assembly including a graded trading card, a label associated with the graded trading card and a clear plastic single sleeve sized and shaped to hold the graded trading card and label, the single sleeve press-fit into the protective display case, the protective display case comprising:

a first chamber sized and shaped to receive and at least partially enclose a first portion of the graded trading card assembly holding the graded trading card; and a second chamber adjoining the first chamber and sized and shaped to receive and at least partially enclose a second portion of the graded trading card assembly holding the label, wherein the first chamber includes three adjoining walls having channels sized and shaped to receive and secure the first portion of the graded trading card assembly without obscuring visibility of the graded trading card through the first chamber, wherein the second chamber includes at least two walls having channels sized and shaped to receive and secure the second portion of the graded trading card assembly without obscuring visibility of the label through the second chamber.

10. The display case of claim 9, further comprising a first, closed end proximate the first chamber; and a second, open end proximate the second chamber, opposite the first end, and sized and shaped so that a user can insert the graded trading card assembly therethrough.

11. The display case of claim 9, further comprising a first, closed end proximate the first chamber; and a second, closed end proximate the second chamber, opposite the first end.

12. The display case of claim 11, wherein the display case is formed from a flexible, elastic material, whereby a user can manipulate the display case to insert and secure the graded trading card assembly therein.

13. The display case of claim 9, further comprising at least one separation member disposed between the first and second chambers, so as to provide a border or separation between the first portion of the graded trading card assembly and the second portion of the graded trading card assembly.

14. The display case of claim 9, wherein the display case is formed from a material selected from a group consisting of plastic, metal, wood, rubber, silicone, leather, fabric, cotton, cardboard, and combinations of one or more thereof.

15. The display case of claim 14, wherein the plastic is selected from a group consisting of Polyethylene Terephthalate, High-Density Polyethylene, Polyvinyl Chloride, Polypropylene, Polystyrene or Styrofoam, resins, metallic resins, and combinations of one more thereof).

16. The display case of claim 14, wherein the metal is selected from a group consisting of aluminum, platinum, gold, silver, steel, alloys of one or more thereof, and combinations of one more thereof.

* * * * *